US007530139B2

(12) United States Patent
Niemeyer et al.

(10) Patent No.: US 7,530,139 B2
(45) Date of Patent: May 12, 2009

(54) MICROFIBER CLEANING APPARATUS WITH CLEANING PAD REMOVAL FEATURE

(75) Inventors: Duane Niemeyer, Aviston, IL (US); Tom Dickinson, St. Louis, MO (US); Harry Haggin, Eureka, MO (US); Greg Maes, Fenton, MO (US); Jon Akin, McDonough, GA (US)

(73) Assignee: Continental Commerical Products LLC, Bridgeton, MO (US)

( * ) Notice: Subject to any disclaimer, the term of this patent is extended or adjusted under 35 U.S.C. 154(b) by 778 days.

(21) Appl. No.: 11/189,969

(22) Filed: Jul. 26, 2005

(65) Prior Publication Data

US 2007/0022553 A1 Feb. 1, 2007

(51) Int. Cl.
*A47L 13/20* (2006.01)
*A47L 13/256* (2006.01)

(52) U.S. Cl. ..... 15/228; 15/147.2; 15/231; 15/257.01

(58) Field of Classification Search ..... 15/147.2, 15/228, 231, 257.01
See application file for complete search history.

(56) References Cited

U.S. PATENT DOCUMENTS

| | | | | |
|---|---|---|---|---|
| 3,199,136 | A | 8/1965 | George | |
| 3,737,938 | A * | 6/1973 | Saltzstein | 15/231 |
| 3,792,505 | A | 2/1974 | Saltzstein | |
| 3,849,825 | A | 11/1974 | Shortte, Jr. | |
| 3,991,431 | A | 11/1976 | Thielen | |
| 4,353,142 | A * | 10/1982 | Nishiyama et al. | 15/144.1 |
| 4,852,210 | A | 8/1989 | Krajicek | |
| 5,071,489 | A | 12/1991 | Silvenis et al. | |
| 5,419,015 | A | 5/1995 | Garcia | |
| 5,461,749 | A | 10/1995 | Ahlberg et al. | |
| 5,483,720 | A | 1/1996 | Decoopman et al. | |
| 5,815,878 | A | 10/1998 | Murakami et al. | |
| 6,098,235 | A | 8/2000 | Tomm et al. | |
| 6,260,226 | B1 | 7/2001 | Specht | |
| 6,659,670 | B1 * | 12/2003 | Blouse | 401/137 |
| 6,684,446 | B2 * | 2/2004 | Salmon | 15/147.2 |
| 2002/0152569 | A1 | 10/2002 | Zorzo | |
| 2003/0037393 | A1 | 2/2003 | Biggs | |
| 2003/0074757 | A1 | 4/2003 | Brinker | |
| 2005/0039286 | A1 | 2/2005 | Brinker et al. | |

FOREIGN PATENT DOCUMENTS

| | | |
|---|---|---|
| CA | 1083761 | 8/1980 |
| JP | 05245091 | 9/1993 |
| WO | 2004075707 | 9/2004 |

* cited by examiner

*Primary Examiner*—Mark Spisich
(74) *Attorney, Agent, or Firm*—Thompson Coburn LLP; Joseph M. Rolnicki, Esq.

(57) ABSTRACT

A cleaning apparatus is comprised of an elongate handle and a cleaning head at one end of the handle. The cleaning head includes a pair of panels that can be moved relative to each other. The panels support a micro fiber cleaning pad. The cleaning pad can be released from the panels after use without manually touching the pad, thereby enabling disposal of a contaminated cleaning pad while reducing the potential for cross contamination to a user of the apparatus.

25 Claims, 11 Drawing Sheets

MICROFIBER CLEANING APPARATUS WITH CLEANING PAD REMOVAL FEATURE

BACKGROUND OF THE INVENTION (1) Field of the Invention

The present invention pertains to a cleaning apparatus that is comprised of an elongate handle and a cleaning head at one end of the handle. The cleaning head is comprised of a pair of panels that can be moved relative to each other. The pair of panels support a micro fiber cleaning pad. The cleaning pad can be released from the panels after use without manually touching the pad, thereby enabling disposal of a contaminated cleaning pad while reducing the potential for cross contamination to a user of the apparatus.

(2) Description of the Related Art

It has been a recent trend in the design of apparatus that are used in cleaning surfaces such as floors and walls to employ micro fiber cleaning pads. For example, current designs of floor mops include a mop head having a micro fiber cleaning pad removably attached to the mop head, whereby the pad can be disposed of or laundered after use.

In order that the cleaning pad be easily removable from the mop head, the mop head is typically designed with clips or other similar types of features. The features removably hold the cleaning pad to the mop head without requiring separate fasteners on the mop head, and without requiring the use of tools in attaching and removing the micro fiber cleaning pad from the mop head.

However, although tools or separate fasteners are not required to attach the micro fiber cleaning pad to the mop head, it is still necessary that the cleaning pad be manually handled when removing the pad from the mop head. Where the micro fiber cleaning pad has been used to clean surfaces of materials that could be hazardous to touch, or where the used cleaning pad is simply undesirable to touch, the task of removing the used cleaning pad from the mop head is, in the least, particularly undesirable, and could be hazardous to the person performing the cleaning task.

What is needed to overcome this disadvantage associated with apparatus that employ micro fiber cleaning pads and other similar types of cleaning pads is a way of removing the used cleaning pad from the apparatus without requiring the manual handling of the used cleaning pad.

SUMMARY OF THE INVENTION

The micro fiber cleaning apparatus of the present invention overcomes the disadvantages associated with prior art apparatus in that it provides a way of removing a used cleaning pad from the apparatus without requiring manually handling the used cleaning pad. The apparatus of the invention is described herein in several embodiments, all of which enable removal of a used cleaning pad from the apparatus without requiring manually touching the cleaning pad. The concept of the invention is described employed on a floor mop apparatus. However, this should not be interpreted as limiting as the concept of the invention may be equally well suited for use in other equivalent types of apparatus.

The apparatus of the invention is basically comprised of a mop head, a micro fiber cleaning pad or other equivalent type of cleaning pad that is removably attached to one side of the mop head, and an elongate handle that is attached to the opposite side of the mop head. The mop head of the invention has a unique construction that enables a user of the apparatus to remove the cleaning pad from the mop head without manually touching the cleaning pad or the mop head.

The mop head is basically comprised of an upper panel, a lower panel, and a cleaning pad. In the preferred embodiment of the invention the cleaning pad is a micro fiber cleaning pad that has a general rectangular configuration. The upper panel is positioned on top of the lower panel, and the lower panel is positioned on top of the cleaning pad. The upper panel and lower panel are connected together by a hinge connection at one of the edges of each panel. The connection enables the upper panel and the lower panel to be pivoted relative to each other.

In each configuration of the apparatus of the invention, the cleaning pad preferably has a rectangular configuration with opposite top and bottom surfaces. The bottom surface of the pad is configured as the pad cleaning surface. The top surface of the pad is designed to be removably attached to the mop head of the apparatus. In the preferred embodiment of the invention, the pad top surface has one or more releasable connector members, for example a loop portion or a hook portion of a Velcro® type fastener.

The lower panel has basically the same size and configuration as the cleaning pad. One or more openings are provided through the lower panel between a top surface of the lower panel and a bottom surface of the lower panel. When the top surface of the cleaning pad is positioned against the bottom surface of the lower panel, the connector members on the cleaning pad top surface are exposed through the lower panel openings.

The upper panel has basically the same size and configuration as the lower panel. The upper panel is connected to the lower panel for movement of the upper panel between first and second positions of the upper panel relative to the lower panel. In the first position, a bottom surface of the upper panel is positioned against the top surface of the lower panel. One or more releasable connectors are provided on the bottom surface of the upper panel. The connectors are positioned to extend through the openings of the lower panel when the upper panel is in the first position relative to the lower panel. In this manner, the connector members on the bottom surface of the upper panel extend through the openings of the lower panel and engage with the connector members on the cleaning pad, thereby releasably connecting the cleaning pad to the mop head. When the upper panel is moved from its first position to its second position relative to the lower panel, the connector members on the upper panel are pulled away from the connector members on the cleaning pad. This releases the cleaning pad from the mop head.

In the first embodiment of the apparatus, the mop head top panel is provided with projections that extend outwardly from a forward edge of the upper panel and a rearward edge of the upper panel. An opening is formed through the center of the upper panel exposing the lower panel beneath the upper panel. A handle of the apparatus is connected to the lower panel through the opening in the upper panel.

A specialized bucket is provided for use with the mop head of the first embodiment. The bucket has a top opening with edge portions on opposite sides of the opening that are dimensioned to engage against the projections of the mop head upper panel.

In use of the first embodiment of the apparatus, when the cleaning pad is designed to be replaced, the mop head is positioned over the top opening of the specialized bucket. The projections extending from the opposite forward and rearward edges of the mop head upper panel are engaged against the edge portions of the bucket that surround the bucket opening. This engagement of the upper panel projections with the edge portions of the bucket holds the mop head upper panel stationary over the top opening of the bucket. When the user presses downwardly on the apparatus handle, the handle pushes the lower panel downwardly relative to the upper panel into the bucket opening. This causes the upper panel and the lower panel of the mop head to move to their second relative positions. This in turn causes the cleaning pad to separate from the upper panel and fall into the bucket interior. In this manner, the cleaning pad is removed from the apparatus without requiring manually touching the cleaning pad.

In the other embodiments of the apparatus, the cleaning pad is removed from the mop head in basically the same manner, without requiring touching the cleaning pad.

The second and third embodiments of the apparatus include actuators that are mounted on the apparatus handle for sliding movement. The actuators are operatively connected to the mop head upper panel. On reciprocating movement of the actuator on the apparatus handle, the actuator moves the mop head upper panel from its first position relative to the lower panel, to its second position relative to the lower panel. This causes the cleaning pad to be separated from the mop head without requiring manually touching the cleaning pad.

In a fourth embodiment of the apparatus, the handle is connected to the mop head upper panel. The upper panel is also provided with an opening at a central portion of the upper panel that exposes the lower panel beneath the upper panel. The actuator mounted on the apparatus handle has a projecting prong that is positioned to pass through the opening in the upper panel and engage against the lower panel. The engagement of the prong against the lower panel pushes the lower panel away from the upper panel, and thereby moves the upper panel and lower panel from their first relatives to their second relative positions. This movement of the upper and lower panels causes the cleaning pad to separate away from the mop head without requiring manually touching the cleaning pad.

All of the embodiments of the apparatus discussed above provide the advantage of enabling a used cleaning pad to be separated from the apparatus without requiring manually touching the cleaning pad.

BRIEF DESCRIPTION OF THE DRAWINGS

Further features of the invention are set forth in the following detailed description of the preferred embodiments of the invention and in the drawing figures wherein.

DETAILED DESCRIPTION OF THE PREFERRED EMBODIMENT

The micro fiber cleaning apparatus of the present invention is provided in several different embodiments, all of which enable removal of a cleaning pad from the apparatus without requiring manually touching the cleaning pad. In the description to follow, the concept of the invention is described employed on a floor mop apparatus. It should be understood that this environment of the concept of the invention is illustrative only, and is not intended to limit the concept of the invention to use on only floor mops. The concept of the invention may be used on various different types of apparatus that support a cleaning pad in use.

Each embodiment of the apparatus of the invention to be described is basically comprised of a mop head, a micro fiber cleaning pad or other equivalent type of cleaning pad that is removably attached to the mop head, and an elongate handle that is attached to and extends from the mop head. Each of the component parts of the invention, apart from the micro fiber cleaning pad, can be constructed of a plastic material as is conventional in the art. Furthermore, although the apparatus of the invention is described as comprising a micro fiber cleaning pad, other types of cleaning pads may be used with the invention.

Figure 1:
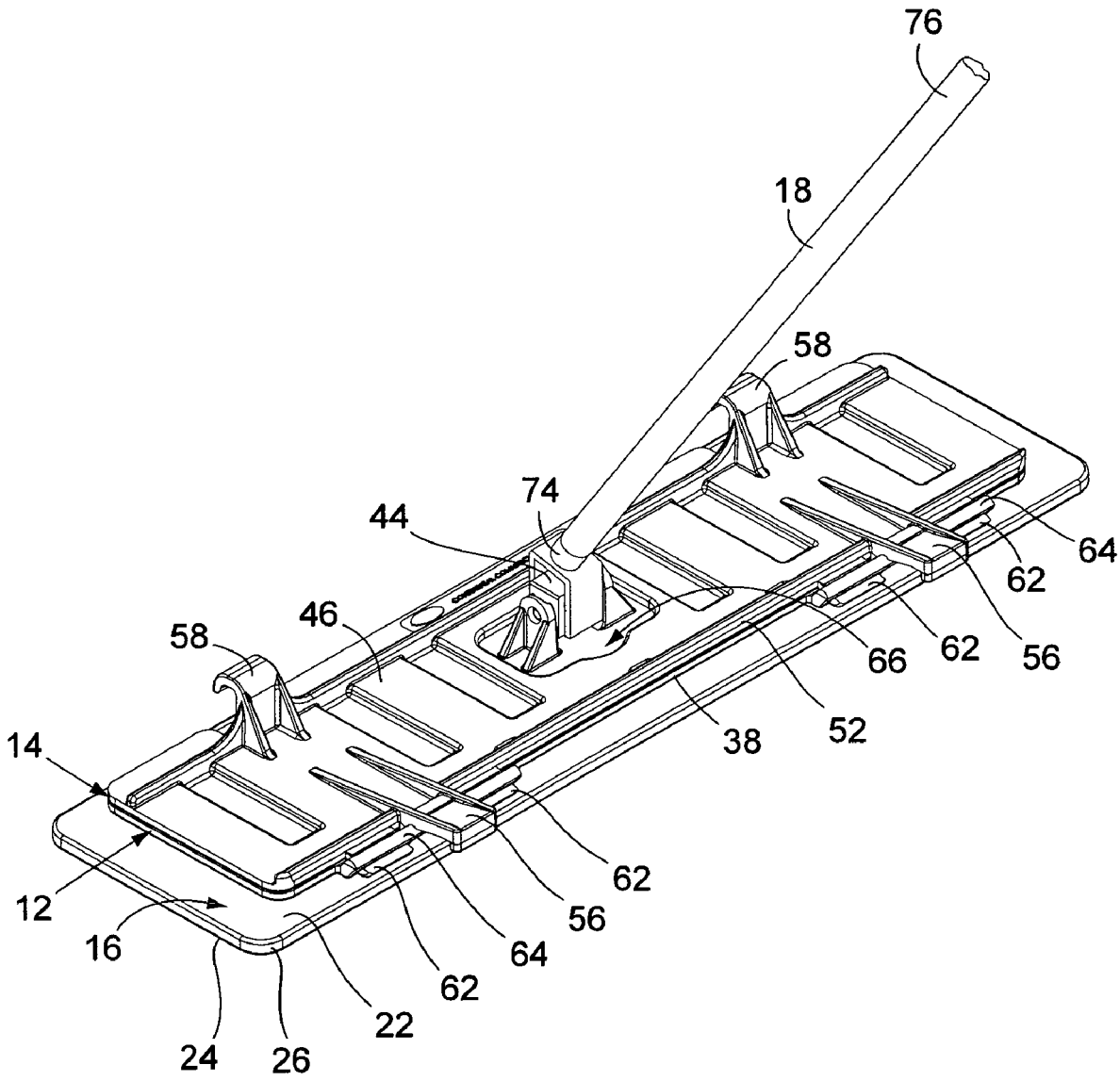
FIG. 1 is a perspective view of the first embodiment of the cleaning apparatus of the invention.

FIG. 1 shows a first embodiment of the apparatus of the invention. The apparatus is basically comprised of a mop head that includes a lower panel 12 and an upper panel 14, a cleaning pad 16 that is removably attached to the mop head, and a handle 18 that extends from the mop head. These basic component parts of the apparatus are employed in each embodiment of the apparatus to be described.

The cleaning pad 16 has a rectangular configuration with opposite top 22 and bottom 24 surfaces. The pad has a peripheral edge 26 that gives the pad its rectangular configuration and separates the pad top surface 22 from the pad bottom surface 24. The bottom surface 24 of the pad is configured as the pad cleaning surface. The top surface 22 of the pad is designed to be removably attached to the mop head of the apparatus.

One or more cleaning pad connector members 32 are mounted on the cleaning pad top surface 22. The connector members 32 can be separately secured to the cleaning pad top surface 22 or can be made a part of the cleaning pad. For example, the connector members 32 could be a loop portion of a loop and hook releasable fastener, such as a Velcro® type fastener. The loop portion of the fastener could be secured to the cleaning pad top surface 22 as the connector member 32, or the material of the cleaning pad itself could function as the loop portion of the fastener.

Figure 2:
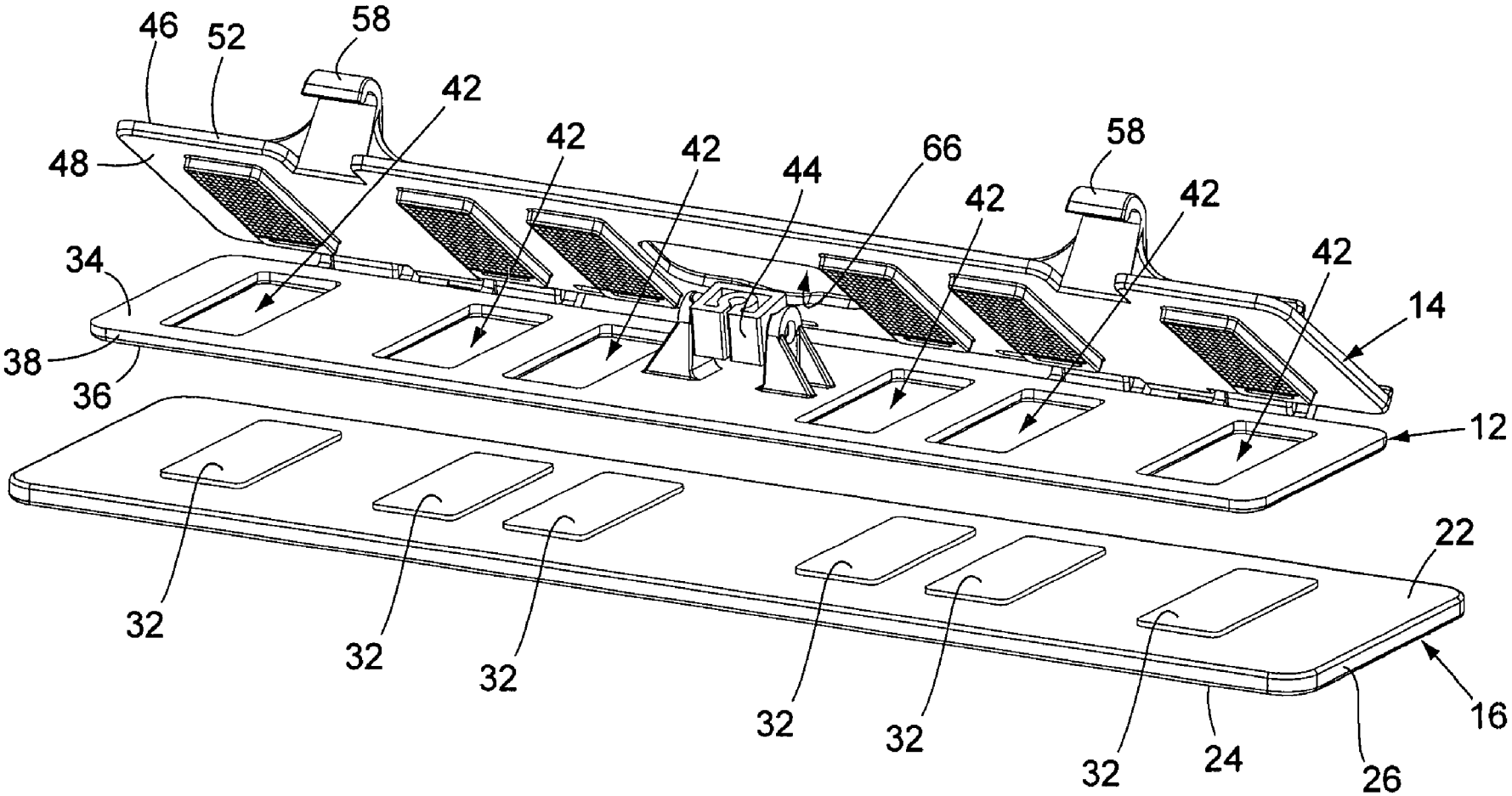
FIG. 2 is perspective view of the upper panel, lower panel, and cleaning pad of the apparatus of FIG. 1.
Figure 3:
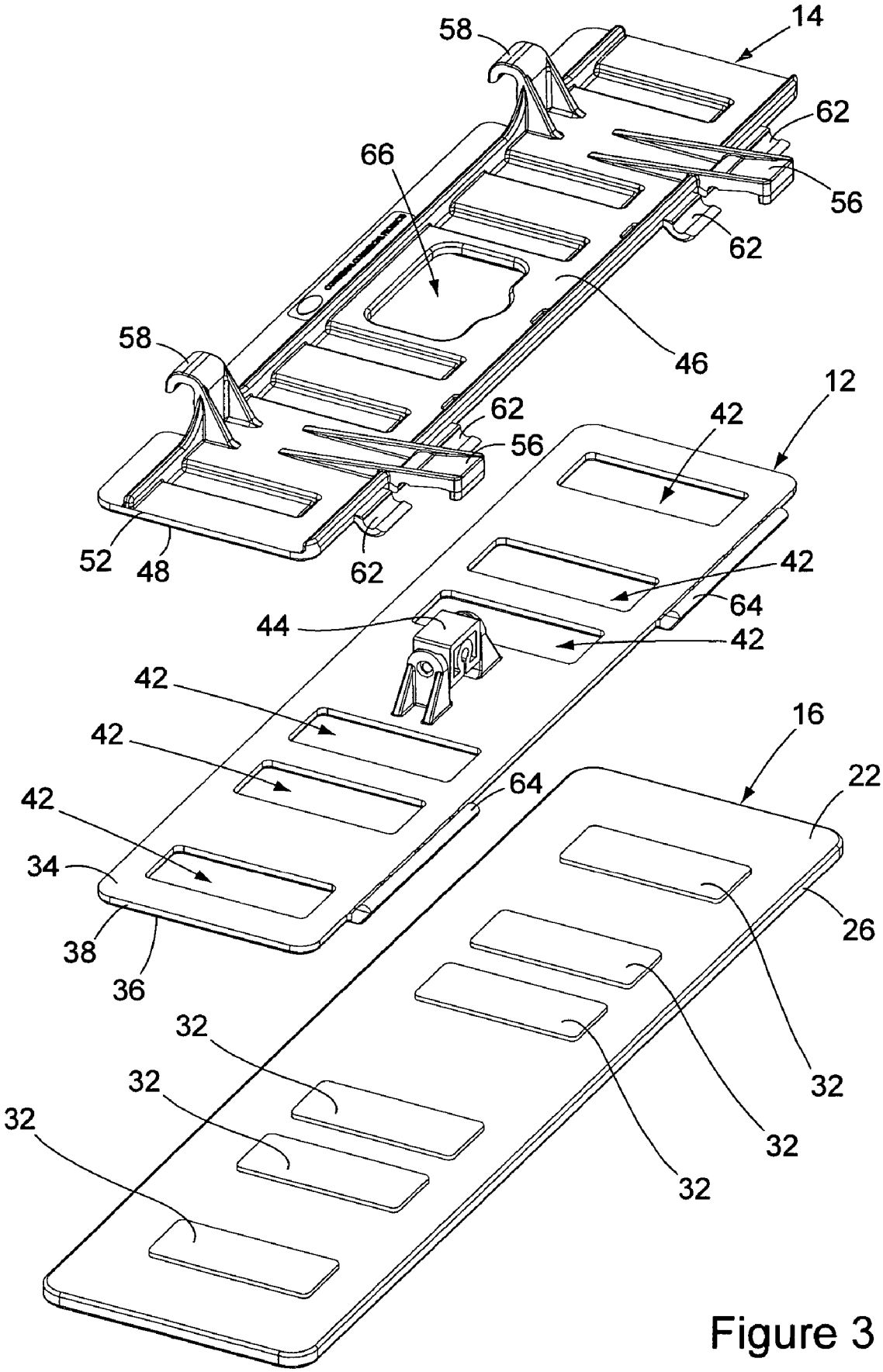
FIG. 3 is a perspective view of the disassembled component parts of the apparatus of in FIG. 1.
Figure 4:
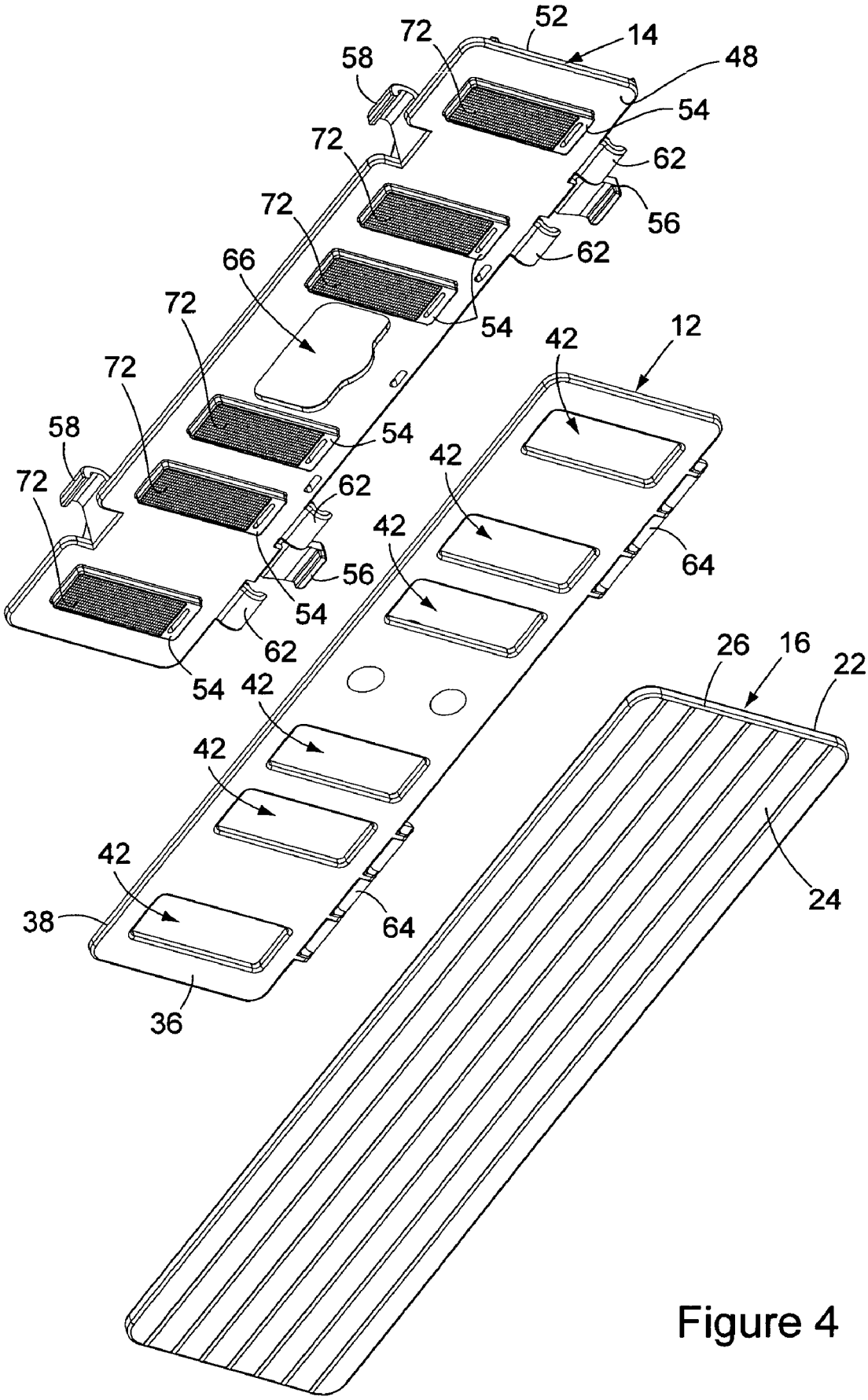
FIG. 4 is a bottom view of the component parts of the apparatus shown in FIG. 3.

The lower panel 12 has basically the same rectangular configuration as the cleaning pad 16. The lower panel has opposite top 34 and bottom 36 surfaces, and a rectangular peripheral edge 38 that separates these surfaces. One or more openings 42 extend through the lower panel. As best seen in FIGS. 2 and 3, the lower panel openings 42 correspond in shape, dimension, and position with the connector members 32 on the cleaning pad top surface 22. When the cleaning pad top surface 22 is positioned opposite and/or against the lower panel bottom surface 36, the connector members 32 of the cleaning pad 16 are exposed through the lower panel openings 42.

A handle connector 44 is provided on a central portion of the lower panel top surface 34. The handle connector 44 in the preferred embodiment of the invention is a universal type coupling that enables pivoting movement about two perpendicular axes of the connector 44.

The upper panel 14 has basically the same size and shape configuration as the lower panel 12. The upper panel 14 has opposite top 46 and bottom 48 surfaces that are separated by a rectangular peripheral edge 52 of the panel. The upper panel bottom surface 48 is provided with a plurality of projecting surface areas 54 that can be seen in FIG. 2. The surface areas 54 are the same in number and have basically the same shape as the lower panel openings 42. The surface areas 54 are positioned on the upper panel bottom surface 48 in the same spatial arrangement as the openings 42 in the lower panel 12.

A pair of planar projections 56 project outwardly from one side of the upper panel 14. These projections 56 are basically positioned in the same plane as the upper panel 14. A second pair of hooked projections 58 project outwardly from the opposite side of the upper panel 14. As seen in FIG. 1, the hooked projections 58 extend outwardly from the upper panel top surface 46 and then curve outwardly over the upper panel peripheral edge 52, forming the hooked configurations of the projections.

A connector mechanism in the form of a hinge assembly 62, 64 connects the upper panel 14 to the lower panel 12. The connector mechanism 62, 64 enables relative movement between the lower panel 12 and the upper panel 14. Other types of connector mechanisms that enable relative movement between the two panels could be used in lieu of the hinge assembly of the connector mechanism 62, 64. As shown in the drawing figures, the hinges of the connector mechanisms 62, 64 connect the lower panel 12 to the upper panel 14 along one edge of each of the two panels. The connection enables relative movement between the lower panel 12 and the upper panel 14 where the upper panel moves between first and second positions of the upper panel relative to the lower panel. FIG. 1 shows the first position of the upper panel 14 relative to the lower panel 12 where the upper panel bottom surface 48 directly opposes the lower panel top surface 34. In this position of the upper panel 14, the projecting surface areas 54 on the upper panel bottom surface 48 extend through the openings 42 in the lower panel 12. FIG. 2 shows the relative positions of the lower panel 12 and the upper panel 14 where the upper panel has been moved to its second position relative to the lower panel. In the second position of the upper panel 14, the upper panel bottom surface 48 no longer opposes the lower panel top surface 34, and the projecting surface areas 54 on the upper panel 14 have been removed from the openings 42 in the lower panel 12.

The upper panel 14 is provided with a central opening 66 in the area of the handle connector 44 on the lower panel 12. This enables the handle connector 44 to extend through the upper panel central opening 66 when the upper panel 14 is moved to its first position relative to the lower panel 12 shown in FIG. 1.

A plurality of upper panel connector members 72 are provided on the projecting surface areas 54 of the upper panel 14. The upper panel connector members 72 are releasably connectable to the cleaning pad connector members 32 by being pressed against the cleaning pad connector members. The upper panel connector members 72 are removable from the cleaning pad connector members 32 by being pulled from the cleaning pad connector members. In the preferred embodiment of the invention, the upper panel connector members 72 are the other of a loop portion or a hook portion of a Velcro® type fastener from the portion of the fastener employed as the cleaning pad connector members 32. Other equivalent types of connector mechanisms may be used.

When the upper panel 14 is moved to its first position relative to the lower panel 12, the projecting surface areas 54 on the upper panel position the upper panel connector members 72 in engagement with the cleaning pad connector members 32 when the cleaning pad 16 it is positioned adjacent the lower panel bottom surface 36. When the upper panel 14 is moved to its second position relative to the lower panel 12 shown in FIG. 2, the upper panel connector members 72 are separated from the cleaning pad connector members 32 and the cleaning pad 16 is free to separate from the lower panel 12 and the upper panel 14.

The handle 18 is connected to the handle connector 44 of the mop head. The handle 18 is preferably an elongate rod having opposite proximal 74 and distal 76 ends. The handle proximal end 74 is secured to the handle connector 44, and thereby the handle 18 is secured to the lower panel 12 and the upper panel 14. The universal connection provided by the handle connector 44 enables the lower panel 12, upper panel 14 and cleaning pad 16 of the mop head to pivot along two perpendicular axes relative to the handle 18 in use of the cleaning apparatus of the invention.

Figure 5:
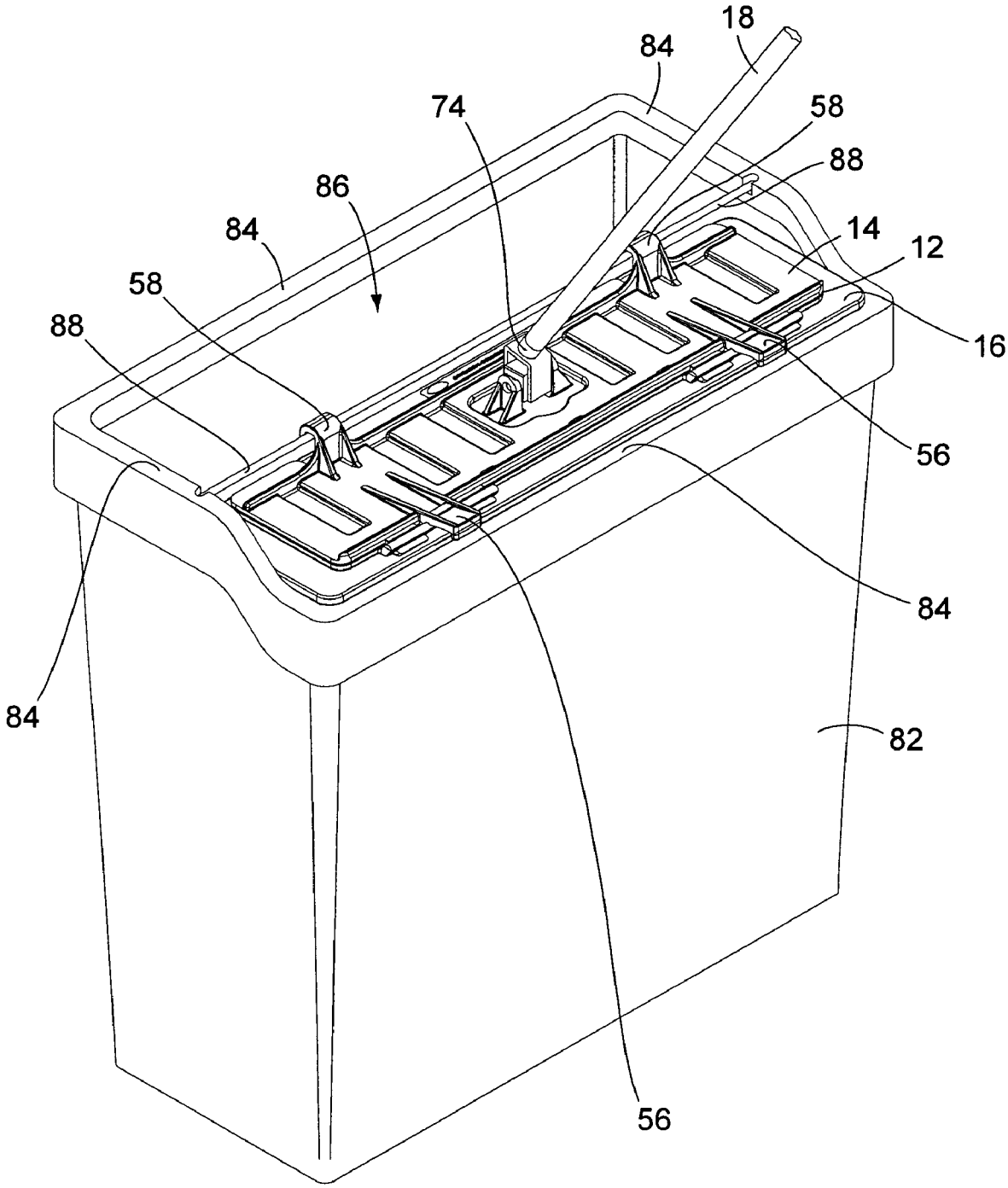
FIG. 5 is a perspective view of the first embodiment of the apparatus of the invention employed with a specialized bucket.

FIG. 5 shows a specialized bucket that is designed for use with the first embodiment of the apparatus described. The bucket 82 has a bottom wall and a plurality of side walls that give the bucket a general cubic configuration. The bucket side walls terminate at top edges 84 of the side walls that surround a top opening 86 of the bucket.

In the particular embodiment of the bucket 82 shown in FIG. 5, a rod 88 extends across the bucket opening 86. The opposite ends of the rod 88 are secured to opposite side wall top edges 84 of the bucket. As shown in FIG. 5, the rod 88 is positioned over the bucket opening 86 to enable insertion of the mop head cleaning pad 16, lower panel 12 and upper panel 14 over the bucket opening 86 between the rod 88 and an adjacent bucket side wall top edge 84.

The positioning of the rod 88 relative to the bucket top edge 84 enables the mop head of the apparatus to be positioned over the bucket opening 86, with the upper panel planar projections 56 engaging against the side wall top edge 84 and the upper panel hooked projections 58 engaging over the rod 88. This supports the upper panel 14 over the bucket opening 86 as shown in FIG. 5. In the relative positions of the lower panel 12, the upper panel 14 and the cleaning pad 16 shown in FIG. 5, the cleaning pad 16 is held to the lower panel bottom surface 36 by the releasable engagement between the cleaning pad connector members 32 and the upper panel connector members 72 through the lower panel openings 42. With the upper panel 14 supported on the bucket 82 as shown in FIG. 5, pushing downwardly on the handle 18 will cause the lower panel 12 to separate from the upper panel 14. The lower panel 12 pivots about the connector mechanism 62, 64 and passes through the bucket opening 86 while the upper panel 14 is supported on the bucket top edge 84 and the bucket rod 88. This relative movement between the lower panel 12 and the upper panel 14 causes the upper panel connector members 72 on the upper panel projecting surface areas 54 to be pulled out of the lower panel openings 42, causing the upper panel connector members 72 to disconnect from the cleaning pad connector members 32. This releases the cleaning pad 16 from its connection to the upper panel 14, and the cleaning pad 16 falls away from the lower panel 12 into the bucket 82. In this manner the cleaning pad 16 can be separated from the mop head of the apparatus without requiring manually touching the cleaning pad.

Figure 6:
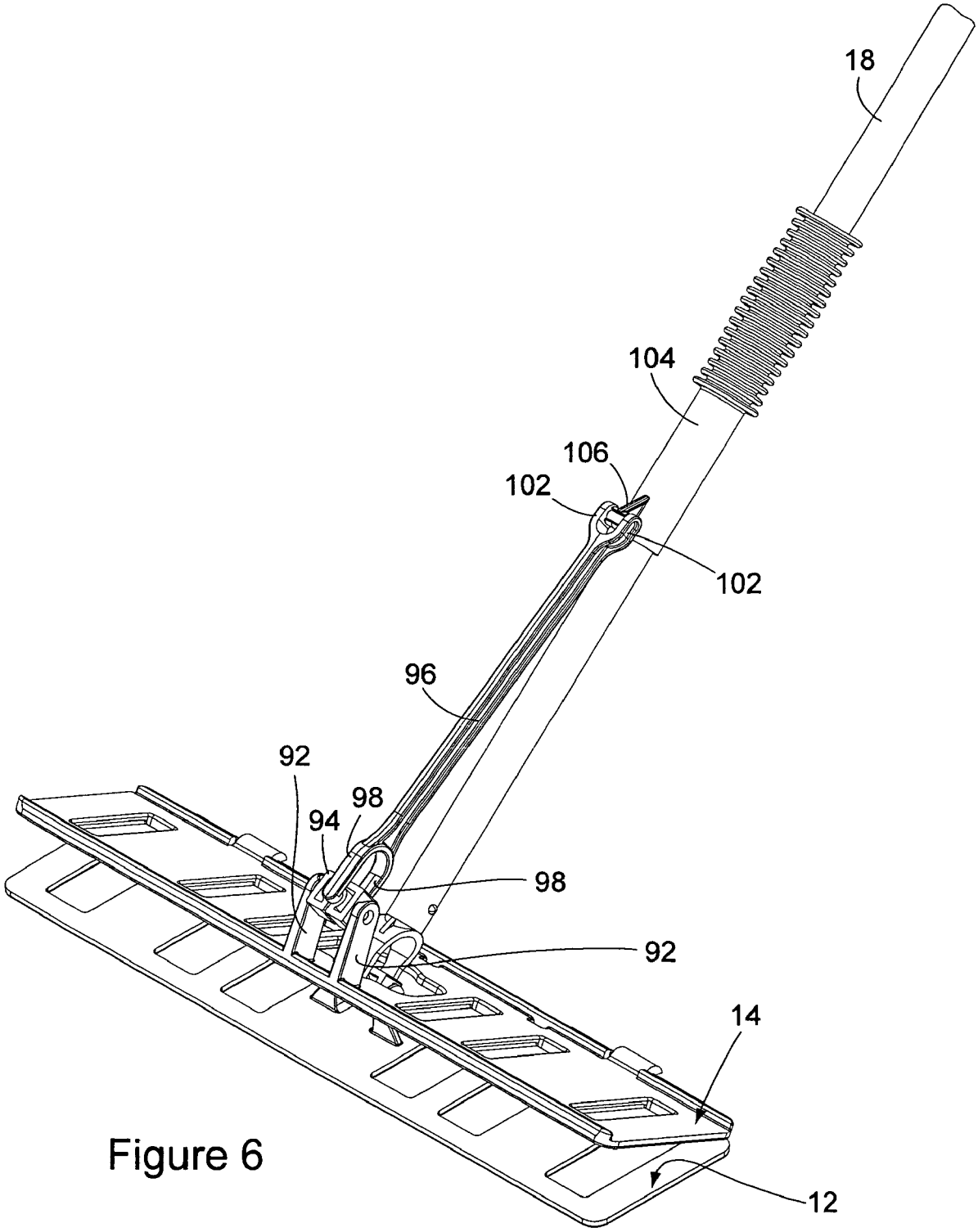
FIG. 6 is a perspective view of the second embodiment of the apparatus.
Figure 7:
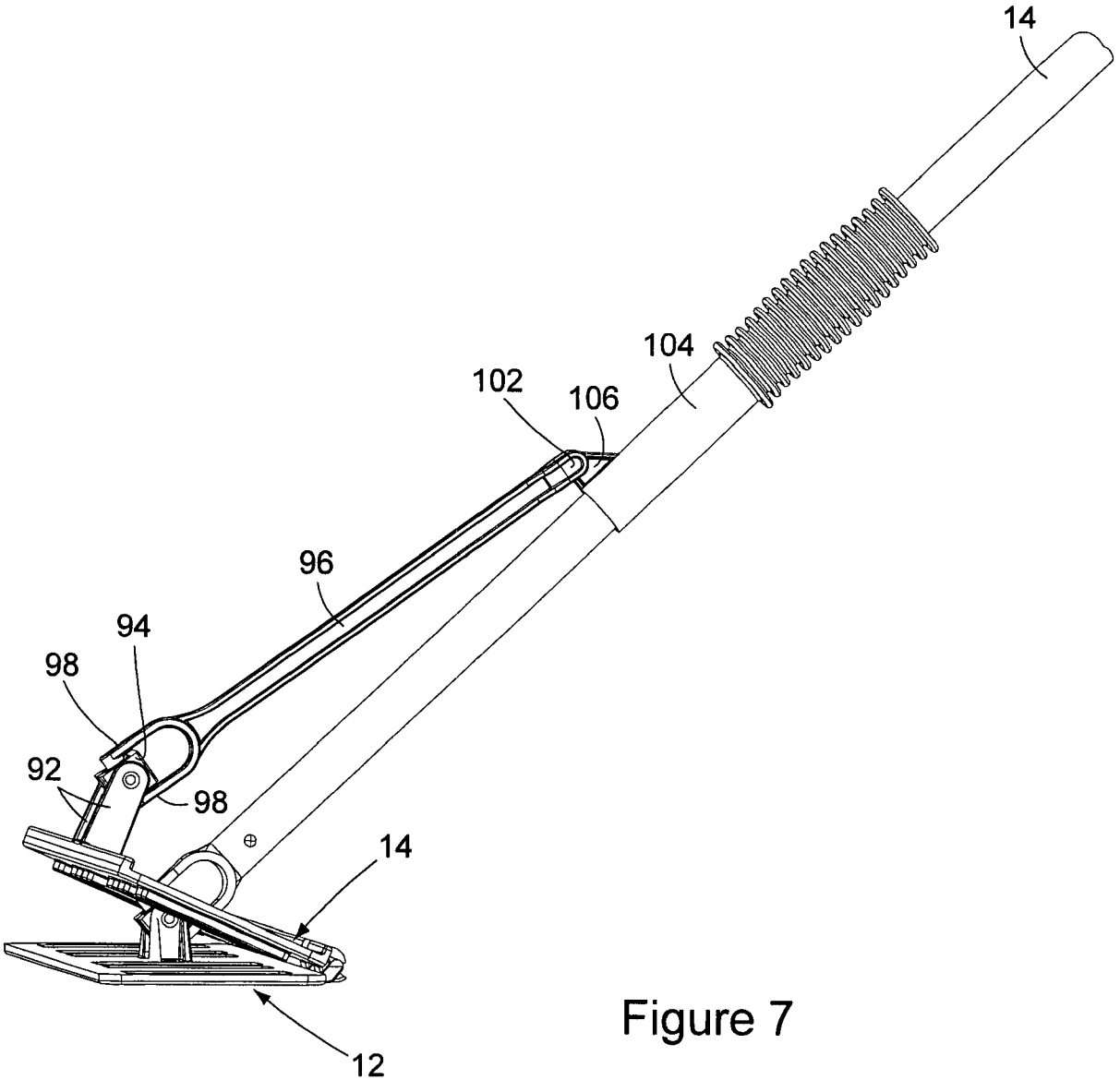
FIG. 7 is a further view of the apparatus of FIG. 6.

FIGS. 6 and 7 show a second embodiment of the apparatus of the invention. The cleaning pad 16 used with the second embodiment of the apparatus is the same as that employed with the first embodiment. Therefore, the cleaning pad 16 is not shown in FIGS. 6 and 7. The lower panel 12 of the mop head is also basically the same as the lower panel 12 employed in the first embodiment of the apparatus of the invention. Therefore, the features of the lower panel 12 shown in FIGS. 6 and 7 are labeled with the same reference numbers employed in describing the lower panel 12 of the first embodiment of the apparatus. The upper panel 14 of the mop head shown in FIGS. 6 and 7 is also basically the same as the upper panel of the first embodiment of the apparatus. Therefore, features of the upper panel 14 shown in FIGS. 6 and 7 that are the same as those of the first embodiment of the apparatus are labeled by the same reference numbers.

The upper panel 14 of FIGS. 6 and 7 is different from that of the first embodiment in that it does not have the planar projections 56 and the hooked projections 58 of the first embodiment. Instead, the upper panel 14 has a pair of spaced flanges 92 that project upwardly from the upper panel top surface 46. The flanges 92 are spaced from each other and are positioned between the upper panel peripheral edge 52 and the central opening 66 through the upper panel.

An actuator connector 94 that has basically the same construction as the handle connector 44 is mounted between the upper panel flanges 92. The actuator connector 94 is a universal type of connector that is capable of pivoting about two mutually perpendicular axes.

An actuator rod 96 is connected to the actuator connector 94. The actuator rod 96 has a length with a proximal end having fork prongs 98 pivotally connected to opposite sides of the actuator connector 94. This connection of the actuator rod 96 to the upper panel 14 by the actuator connector 94 and the upper panel flanges 92 allows the rod 96 to pivot through two mutually perpendicular planes relative to the upper panel 14. The opposite distal end of the actuator rod 96 is formed with a pair of distal end prongs 102.

A tubular actuator sleeve 104 is mounted on the handle 18 for reciprocating sliding movement of the sleeve over the handle. A sleeve flange 106 projects outwardly from the sleeve proximal end and is connected by a pivot pin connection to the actuator rod distal end prongs 102. This provides an operative connection between the actuator sleeve 104 and the mop head upper panel 14.

The operative connection between the actuator sleeve 104 and the mop head upper panel 14 controls movement of the upper panel 14 between its first and second positions relative to the lower panel 12 by reciprocating movements of the actuator sleeve 104 on the handle 18. Movement of the actuator sleeve 104 toward the mop head moves the upper panel 14 to its first position relative to the lower panel 12. Movement of the actuator sleeve 104 away from the mop head moves the upper panel 14 away from the lower panel 12 to its second position relative to the lower panel. Movement of the upper panel 14 from its first position to its second position relative to the lower panel 12 in response to movement of the actuator sleeve 104 on the handle 18 also causes the cleaning pad 16 to separate from the mop head in the same manner as the first embodiment of the apparatus. Thus, by moving the actuator sleeve 104 on the handle 18 away from the mop head, the cleaning pad 16 is released from its connection to the upper panel 14 of the second embodiment of the apparatus, and the cleaning pad 16 falls away from the lower panel 12. In this manner, the cleaning pad 16 can be separated from the mop head of the second embodiment of the apparatus shown in FIGS. 6 and 7 without requiring manually touching the cleaning pad.

Figure 8:
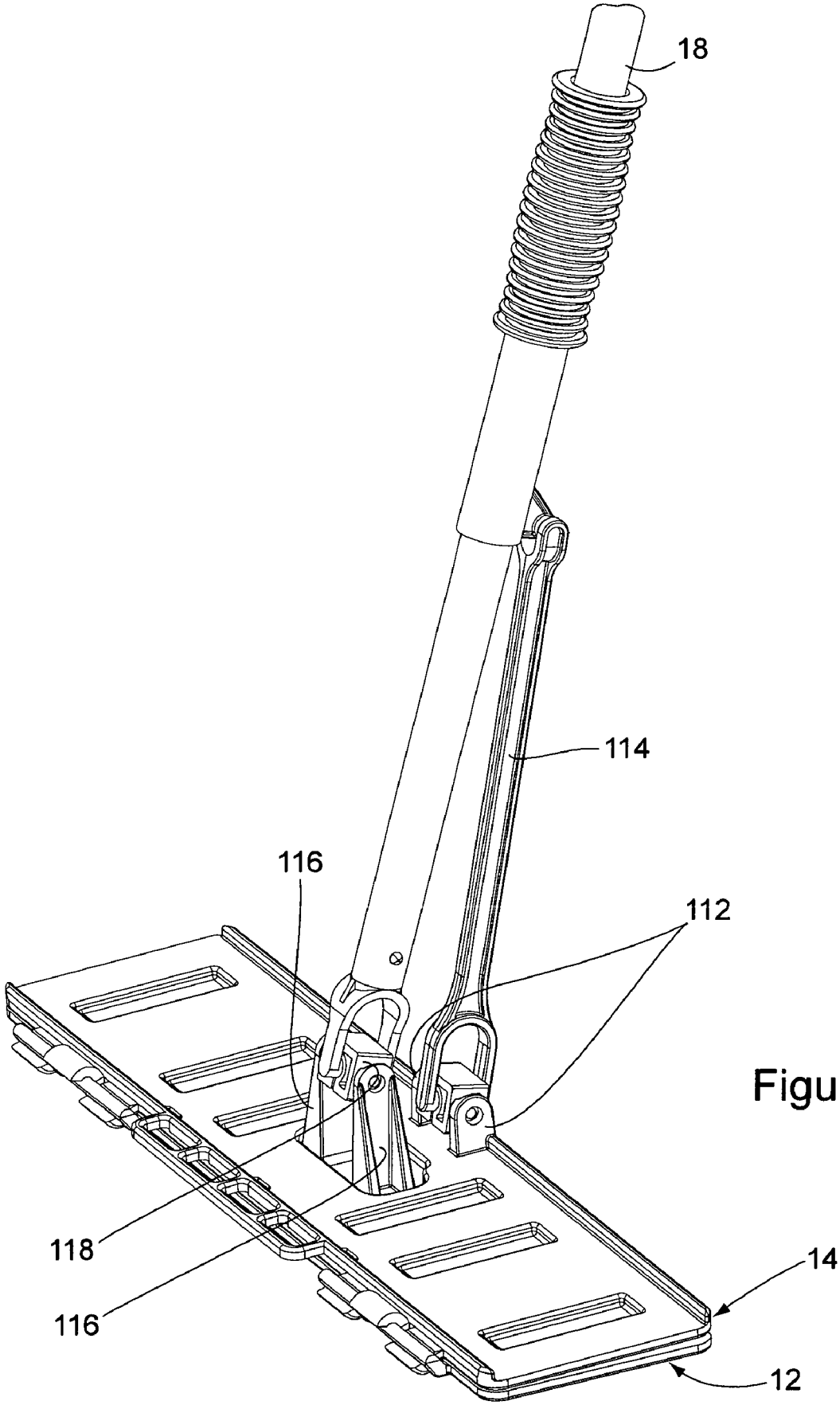
FIG. 8 is a perspective view of a third embodiment of the apparatus.
Figure 9:
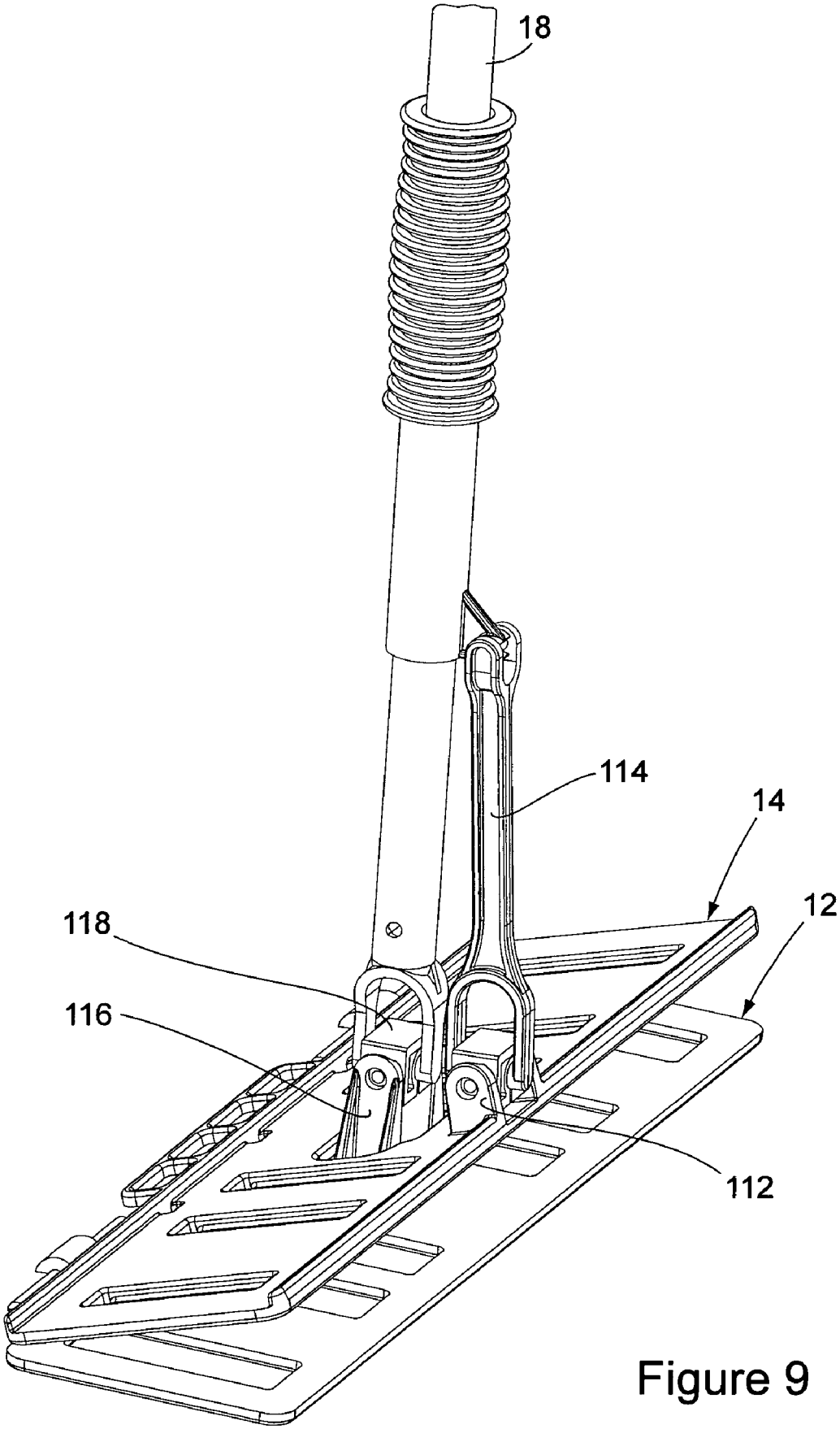
FIG. 9 is a further view of the apparatus of FIG. 8.

FIGS. 8 and 9 show a third embodiment of the apparatus of the invention. The third embodiment of the apparatus is basically the same in construction as the second embodiment, except that the length of the upper panel flanges 112 are shorter than those of the second embodiment. In addition, the length of the actuator rod 114 in the third embodiment is shorter than that of the second embodiment. The pair of lower panel flanges 116 that pivotally support the handle connector 118 on the mop head lower panel 12 are also longer than those of the first and second embodiments, whereby the handle connector 118 extends a slightly greater distance through the upper panel central opening 66. These differences in construction enable the handle 18 to be oriented at an angle relative to the mop head, where the angled orientation of the handle 18 is reversed 180° from that of the handle relative to the mop head in the first and second embodiments of the apparatus. Thus, where the mop head connector mechanism 62 connecting the upper 14 and lower 12 panels of the first and second embodiments is at the trailing edge of the mop head when the mop head is pushed by the handle, in the third embodiment shown in FIGS. 8 and 9, the connector mechanism 62 is at the leading edge of the mop head when the mop head is pushed by the handle 18. Apart from these differences, the operation of the third embodiment of the apparatus shown in FIGS. 8 and 9 is basically the same as that of the previously described second embodiment of the apparatus shown in FIGS. 6 and 7.

Figure 10:
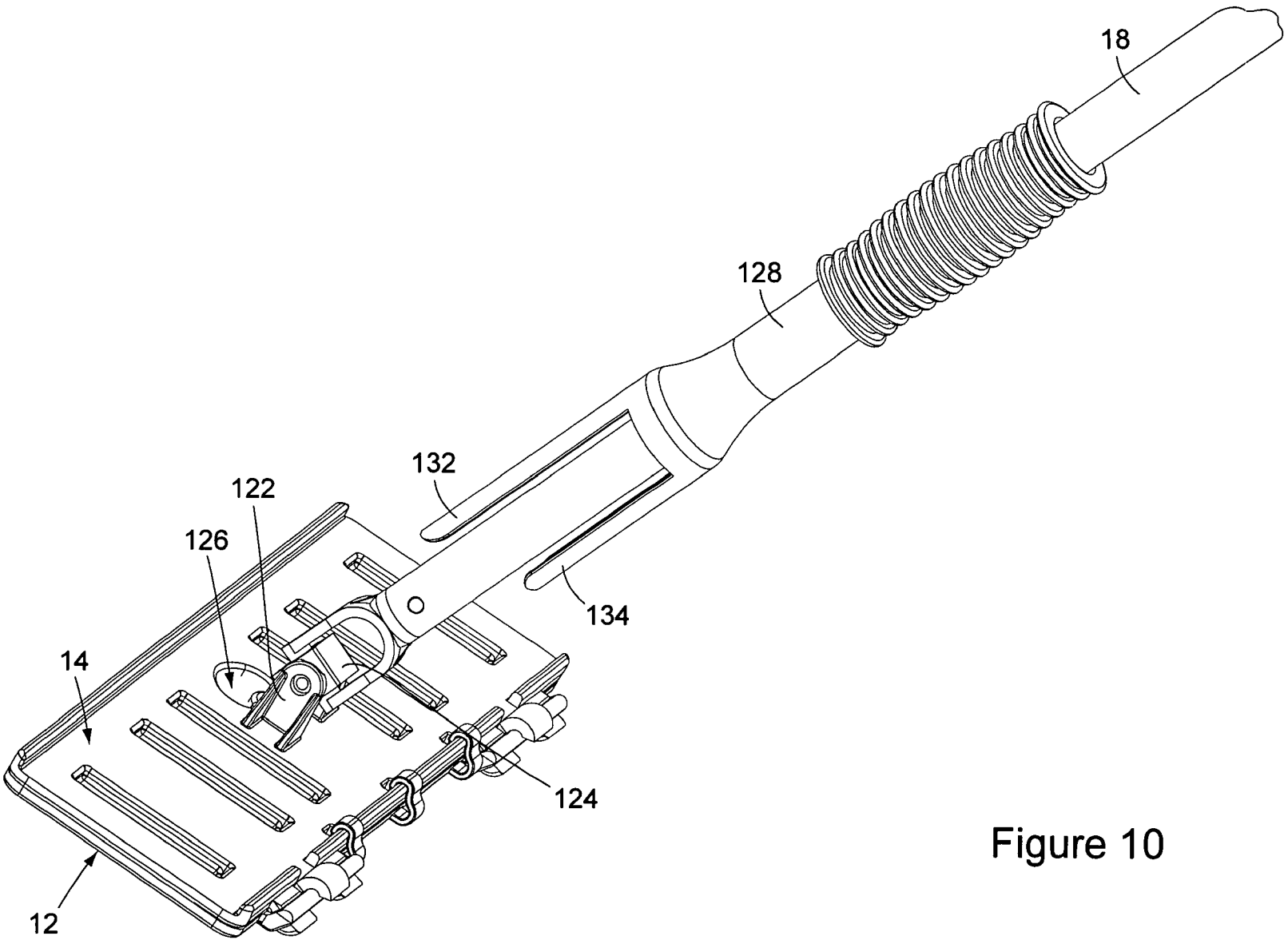
FIG. 10 is a perspective view of a fourth embodiment of the apparatus.
Figure 11:
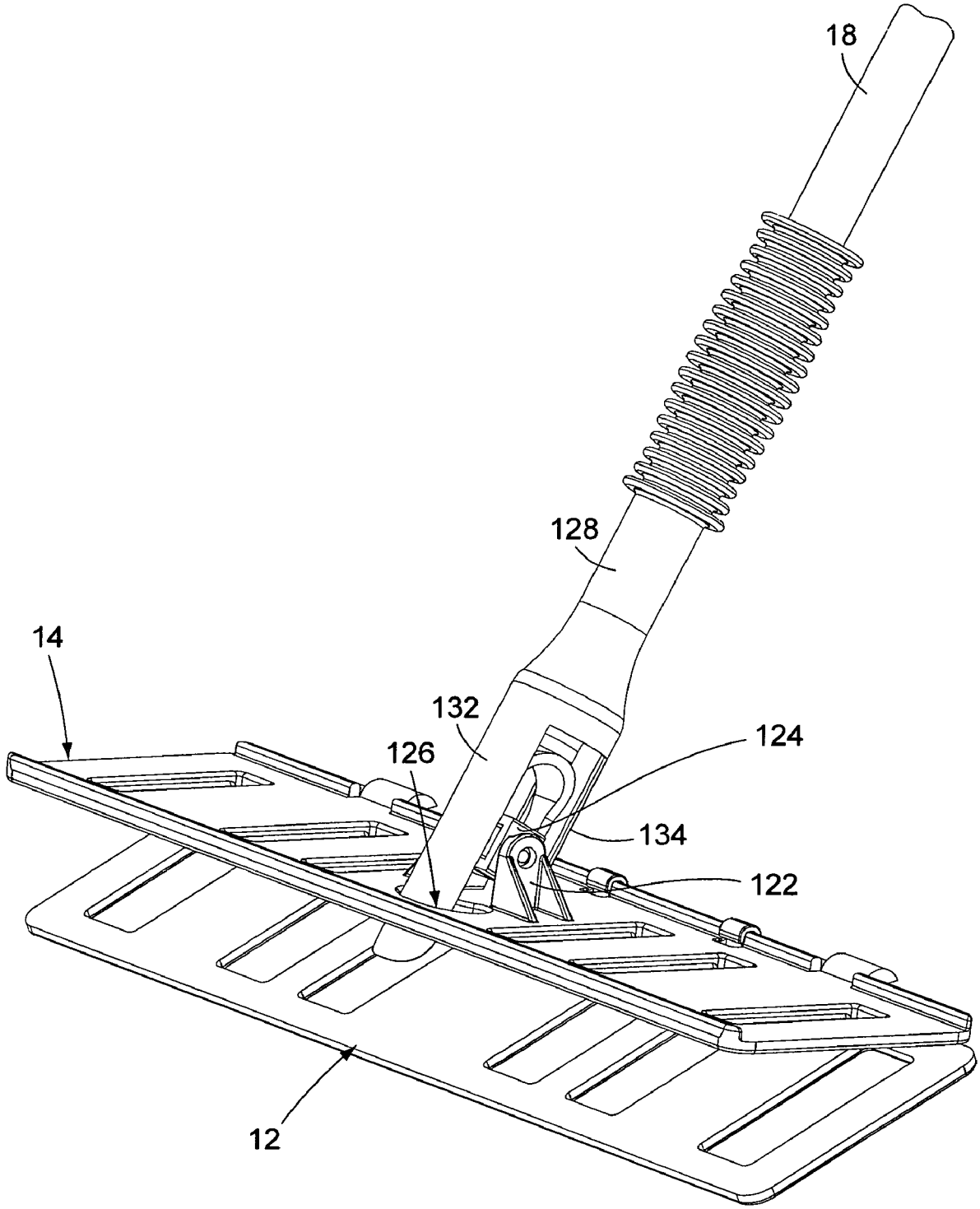
FIG. 11 is a further view of the apparatus of FIG. 10.

FIGS. 10 and 11 show a fourth embodiment of the apparatus of the invention. Again, the cleaning pad 16 used with the fourth embodiment of the apparatus is the same as that employed with the first embodiment. Therefore, the cleaning pad 16 is not shown in FIGS. 10 and 11. The lower panel 12 of the mop head is also basically the same as the lower panel 12 employed in the first embodiment of the apparatus of the invention. Therefore, the features of the lower panel 12 shown in FIGS. 10 and 11 are labeled with the same reference numbers employed in describing the lower panel 12 of the first embodiment of the apparatus. The upper panel 14 of the mop head shown in FIGS. 10 and 11 is also basically the same as the upper panel of the first embodiment of the apparatus. Therefore, the features of the upper panel 14 shown in FIGS. 10 and 11 that are the same as those of the first embodiment of the apparatus are labeled by the same reference numbers.

The lower panel 12 of FIGS. 10 and 11 is different from that of the first embodiment in that it does not have the handle connector 44 projecting upwardly from the middle of the lower panel top surface 34. Apart from this one difference, the lower panel 12 of the fourth embodiment of the apparatus shown in FIGS. 10 and 11 is basically the same in construction as the lower panel 12 of the first described embodiment. As in the first described embodiment, the connector mechanisms 62, 64 connects the lower panel 12 to the upper panel 14 along side edges of each of the two panels.

The upper panel 14 of FIGS. 10 and 11 is different of that of the first embodiment in that it does not have the planar projections 56 and the hooked projections 58 of the first embodiment. In addition, the upper panel 14 does not have the central opening 66 of the first embodiment. Instead, the upper panel 14 of the fourth embodiment shown in FIGS. 10 and 11 is provided with a pair of upper panel flanges 122 that project upwardly from the central portion of the upper panel top surface 46. The handle connector 124 is mounted between the pair of flanges 122 for pivoting movement of the connector relative to flanges. As in the first embodiment, the handle connector 124 is a universal connector that allows pivoting movement about two mutually perpendicular axes. The upper panel 14 of the fourth embodiment shown in FIGS. 10 and 11 also differs from that of the first embodiment in that it is provided with a central opening 126 through the upper panel that is positioned on an opposite side of the pair of upper panel flanges 122 from the connector mechanism 62.

Fork prongs at the handle proximal end 74 are connected to the handle connector 124. The connection provided by the handle connector 124 allows the handle 18 to pivot through two mutually perpendicular planes relative to the mop head.

A tubular actuator sleeve 128 is mounted on the handle 18 for reciprocating sliding movement of the sleeve over the handle. A pair of sleeve prongs 132, 134 project outwardly from the sleeve proximal end. As seen in FIGS. 10 and 11, one of the sleeve prongs 132 is longer than the other of the sleeve prongs 134. The longer sleeve prong 132 is positioned on the handle 18 so that it aligns with the upper panel opening 126.

As in the previously described embodiments, reciprocation of the actuator sleeve 128 on the handle 18 controls the movement of the upper panel 14 between its first and second positions relative to the lower panel 12. By moving the actuator sleeve 128 from its position shown in FIG. 10, toward the mop head as shown in FIG. 11, the longer actuator sleeve prong 132 will pass through the upper panel opening 126 and engage against the lower panel top surface 34. With the upper panel 14 secured to the handle 18 by the handle connector 124, the movement of the actuator sleeve 128 toward the mop head causes the longer actuator sleeve prong 132 to push the lower panel 12 away from the upper panel 14. The movement of the upper panel 14 from its first position relative to the lower panel 12 shown in FIG. 10 to its second position relative to the lower panel 12 shown in FIG. 11 causes the cleaning pad 16 to separate from the mop head in the same manner as the first embodiment of the apparatus. Thus, by moving the actuator sleeve 128 on the handle 18 toward the mop head, the longer actuator sleeve prong 132 causes relative movement between the lower panel 12 and upper panel 14. This relative movement of the panels causes the cleaning pad 16 to be released from its connection to the upper panel 14, and the cleaning pad 16 falls away from the lower panel 12. In this manner, the cleaning pad 16 can be separated from the mop head of the fourth embodiment of the apparatus shown in FIGS. 10 and 11 without requiring manually touching the cleaning pad.

All of the embodiments of the apparatus discussed above provide the advantage of enabling a used cleaning pad to be separated from the apparatus mop head without requiring manually touching the cleaning pad.

Although the subject matter of the invention has been described above by reference to particular embodiments, it should be understood that modifications and variations may be made to the invention without departing from the intended scope of protection provided by the following claims.

The invention claimed is:

1. A cleaning apparatus comprising:

a lower panel having opposite top and bottom surfaces;

an upper panel having opposite top and bottom surfaces;

a connection mechanism between the lower panel and the upper panel that enables relative movement between the upper panel and the lower panel whereby the upper panel moves between first and second positions of the upper panel relative to the lower panel, where in the first position the upper panel bottom surface is positioned adjacent to the lower panel top surface and in the second position the upper panel bottom surface is moved away from the lower panel top surface;

a cleaning pad having opposite top and bottom surfaces; and, a connector assembly between the cleaning pad top surface and the upper panel bottom surface that releasably connects the cleaning pad to the upper panel when the cleaning pad top surface is positioned adjacent to the lower panel bottom surface and the upper panel is in the first position, and that disconnects the cleaning pad from the upper panel when the upper panel is moved to the second position.

2. The apparatus of claim 1, further comprising:

the lower panel, the upper panel, and the cleaning pad being layered together with the upper panel and cleaning pad on opposite sides of the lower panel when the upper panel is in the first position and connector assembly releasably connects the cleaning pad to the upper panel.

3. The apparatus of claim 2, further comprising:

the connector assembly extending past the lower panel and not being connected to the lower panel when the connector assembly releasably connects the cleaning pad to the upper panel.

4. The apparatus of claim 2, further comprising:

the lower panel having at least one opening in the lower panel; and, the connector assembly extending through the lower panel opening and not being connected to the lower panel when the connector assembly releasably connects the cleaning pad to the upper panel.

5. The apparatus of claim 4, further comprising:

the connector assembly comprising an upper panel member on the upper panel bottom surface and a cleaning pad member on the cleaning pad top surface, the upper panel member and the cleaning pad member being connectable when pressed together, and being disconnectable when pulled apart.

6. The apparatus of claim 1, further comprising:

a handle having an elongate length with opposite proximal and distal ends, the handle proximal end being operatively connected to one of the lower panel and the upper panel; and, an actuator mounted on the handle for movement of the actuator relative to the handle, the actuator being operatively connected to the other of the lower panel and the upper panel that is not operatively connected to the handle proximal end to cause relative movement of the upper panel and the lower panel between the first and second positions of the upper panel relative to the lower panel in response to movement of the actuator relative to the handle.

7. The apparatus of claim 6, further comprising:

the actuator comprising a tubular sleeve that is mounted on the handle for sliding, reciprocating movement of the sleeve on the handle.

8. The apparatus of claim 7, further comprising:

the handle proximal end being operatively connected to the lower panel; and, an actuator rod connected between the tubular sleeve and the upper panel for movement of the actuator rod relative to the tubular sleeve and the upper panel.

9. The apparatus of claim 7, further comprising:

the handle proximal end being operatively connected to the upper panel; and, the tubular sleeve having an end that is engagable with the lower panel in response to movement of the tubular sleeve on the handle.

10. The apparatus of claim 1, further comprising:

a first projection projecting outwardly from the upper panel at one side of the upper panel and a second projection projecting outwardly from the upper panel at an other side of the upper panel; and, a bucket having a top opening and at least first and second edges adjacent the bucket top opening, the first and second edges being positioned to engage with the respective first and second projections on the upper panel and to support the upper panel adjacent the bucket top opening, the bucket first and second edges having relative positions that enable the lower panel to pass between the first and second edges and through the bucket top opening when the first and second projections on the upper panel are engaged with the respective first and second edges and the upper panel and lower panel are moved relative to each other.

11. A cleaning apparatus comprising:

a lower panel having opposite top and bottom surfaces;

an upper panel having opposite top and bottom surfaces;

means for connecting the upper panel to the lower panel for movement of the upper panel between first and second positions of the upper panel relative to the lower panel, where in the first position the upper panel bottom surface is positioned directly opposing the lower panel top surface and in the second position the upper panel bottom surface is moved away from directly opposing the lower panel top surface;

a cleaning pad having opposite top and bottom surfaces; and, means for releasably connecting the cleaning pad to the upper panel when the cleaning pad top surface is positioned directly opposing the lower panel bottom surface and the upper panel is in the first position, and for disconnecting the cleaning pad from the upper panel when the cleaning pad top surface is positioned directly opposing the lower panel bottom surface and the upper panel is moved from the first position to the second position.

12. The apparatus of claim 11, further comprising:

the lower panel, the upper panel, and the cleaning pad being positioned in a stacked arrangement with the upper panel and the cleaning pad being on opposite sides of the lower panel when the upper panel is in the first position and the means for releasably connecting the cleaning pad to the upper panel is connecting the upper panel to the cleaning pad.

13. The apparatus of claim 12, further comprising:

the means for releasably connecting the cleaning pad to the upper panel comprising a connector assembly that extends between the cleaning pad and the upper panel past the lower panel and is not connected to the lower panel.

14. The apparatus of claim 11, further comprising:

a handle having an elongate length with opposite proximate and distal ends, the handle proximal end being operatively connected to one of the lower panel and the upper panel; and, an actuator mounted on the handle for movement of the actuator relative to the handle, the actuator being operatively connected to the other of the lower panel and the upper panel that is not operatively connected to the handle proximal end to cause relative movement of the upper panel and the lower panel between the first and second positions of the upper panel relative to the lower panel in response to movement of the actuator relative to the handle.

15. The apparatus of claim 14, further comprising:

the actuator comprising a tubular sleeve that is mounted on the handle for sliding, reciprocating movement of the sleeve on the handle.

16. The apparatus of claim 15, further comprising:

the handle proximal end being operatively connected to the lower panel; and, an actuator rod connected between the tubular sleeve and the upper panel for movement of the actuator rod relative to the tubular sleeve and the upper panel.

17. The apparatus of claim 15, further comprising:

the handle proximal end being operatively connected to the upper panel; and, the tubular sleeve having an end that is engagable with the lower panel in response to movement of the tubular sleeve on the handle.

18. The apparatus of claim 11, further comprising:

a first projection projecting outwardly from the upper panel at one side of the upper panel and a second projection projecting outwardly from the upper panel at an other side of the upper panel; and, a bucket having a top opening and at least first and second edges adjacent the bucket top opening, the first and second edges being positioned to engage the respective first and second projections on the upper panel and to support the upper panel adjacent the bucket top opening, the bucket first and second edges having relative positions that enable the lower panel to pass between the first and second edges and through the bucket top opening when the first and second projections on the upper panel are engaged with the respective first and second edges and the upper panel and lower panel are moved relative to each other.

19. A cleaning apparatus comprising:

a cleaning pad having opposite top and bottom surfaces and a peripheral edge that extends around the cleaning pad and separates the cleaning pad top surface from the cleaning pad bottom surface, the cleaning pad bottom surface being designed as a cleaning surface;

a cleaning pad connector member mounted on the cleaning pad top surface;

a lower panel having opposite top and bottom surfaces and a peripheral edge that extends around the lower panel and separates the lower panel top surface from the lower panel bottom surface, the lower panel having an opening through the lower panel that is positioned in the lower panel to expose through the opening the cleaning pad connector member when the cleaning pad top surface is positioned in engagement with the lower panel bottom surface;

an upper panel having opposite top and bottom surfaces and a peripheral edge that extends around the upper panel and separates the upper panel top surface from the upper panel bottom surface;

a connector mechanism connecting the lower panel and the upper panel for relative movement between the lower panel and the upper panel whereby the upper panel moves between first and second positions of the upper panel relative to the lower panel where in the first position the upper panel bottom surface opposes the lower panel top surface and in the second position the upper panel bottom surface is displaced from opposing the lower panel top surface; and, an upper panel connector member mounted on the upper panel bottom surface where the upper panel connector member extends through the lower panel opening and engages and connects to the cleaning pad connector member when the cleaning pad top surface is positioned in engagement with the lower panel bottom surface and the upper panel is in the first position, and disconnects from the cleaning pad connector member when the upper panel is moved to the second position.

20. The apparatus of claim 19, further comprising:

the upper panel, the lower panel, and the cleaning pad being arranged in a stacked arrangement with the upper panel and the cleaning pad being positioned on opposite sides of the lower panel when the upper panel is in the first position.

21. The apparatus of claim 19, further comprising:

a handle having an elongate length with opposite proximate and distal ends, the handle proximal end being operatively connected to one of the lower panel and the upper panel; and, an actuator mounted on the handle for movement of the actuator relative to the handle, the actuator being operatively connected to the other of the lower panel and the upper panel that is not operatively connected to the handle proximal end to cause relative movement of the upper panel and the lower panel between the first and second positions of the upper panel relative to the lower panel in response to movement of the actuator relative to the handle.

22. The apparatus of claim 21, further comprising:

the actuator comprising a tubular sleeve that is mounted on the handle for sliding, reciprocating movement of the sleeve on the handle.

23. The apparatus of claim 22, further comprising:

the handle proximal end being operatively connected to the lower panel; and, an actuator rod connected between the tubular sleeve and the upper panel for movement of the actuator rod relative to the tubular sleeve and the upper panel.

24. The apparatus of claim 22, further comprising:

the handle proximal end being operatively connected to the upper panel; and, the tubular sleeve having an end that is engagable with the lower panel in response to movement of the tubular sleeve on the handle.

25. The apparatus of claim 19, further comprising:

a first projection projecting outwardly from the upper panel at one side of the upper panel and a second projection projecting outwardly from the upper panel at an other side of the upper panel; and, a bucket having a top opening and at least first and second edges adjacent the bucket top opening, the first and second edges being positioned to engage the respective first and second projections on the upper panel and to support the upper panel adjacent the bucket top opening, the bucket first and second edges having relative positions that enable the lower panel to pass between the first and second edges and through the bucket top opening when the first and second projections on the upper panel are engaged with the respective first and second edges and the upper panel and lower panel are moved relative to each other.

* * * * *